US006042207A

United States Patent [19]

Crosby et al.

[11] Patent Number: 6,042,207

[45] Date of Patent: Mar. 28, 2000

[54] RECONFIGURABLE INTERIOR STRUCTURE FOR SAFES AND THE LIKE

[75] Inventors: Gaius P. Crosby, Springville; James A. Skousen, Orem, both of Utah

[73] Assignee: Liberty Safe & Security Products, Inc., Springville, Utah

[21] Appl. No.: 09/123,697

[22] Filed: Jul. 28, 1998

[51] Int. Cl.[7] ..... A47B 97/00; A47F 7/00

[52] U.S. Cl. ..... 312/351; 312/257.1; 2111/64; 2111/153

[58] Field of Search ..... 312/351, 257.1, 312/205, 206, 207, 265.6, 282, 3; 211/64, 2, 1.3, 153; 206/317

[56] References Cited

U.S. PATENT DOCUMENTS

| | | | |
|---|---|---|---|
| 439,562 | 10/1890 | Richards | 211/64 X |
| 1,833,081 | 11/1931 | Kilmer | 312/351 X |
| 2,517,757 | 8/1950 | Adlerstein | 312/3 |
| 3,834,325 | 9/1974 | DeWilde | 211/153 X |
| 3,948,581 | 4/1976 | Helman et al. | 312/257.1 X |
| 4,113,107 | 9/1978 | Jaeger | 211/64 X |
| 4,134,625 | 1/1979 | Palka | 312/206 |
| 4,344,660 | 8/1982 | Molnar et al. | 312/249.13 |
| 4,960,308 | 10/1990 | Donaghy | 211/153 X |
| 5,228,581 | 7/1993 | Palladino et al. | 211/153 |
| 5,265,950 | 11/1993 | Atkinson | 211/64 X |
| 5,454,931 | 10/1995 | Lauve | 312/265.5 X |
| 5,538,147 | 7/1996 | Fucci | 211/153 |
| 5,772,295 | 6/1998 | Sundmark | 312/242 X |

OTHER PUBLICATIONS

Bass Pro Shops/Red Head, "1998 Fall Specialists Catalog", p. 139, Jul. 1998.

*Primary Examiner*—Peter M. Cuomo
*Assistant Examiner*—James O. Hansen
*Attorney, Agent, or Firm*—Thorpe, North & Western, LLP

[57] ABSTRACT

A reconfigurable interior structure for safes and the like includes a vertical divider supporting a reconfigurable rack having cut-out portions, the reconfigurable rack being alterable to appear and function as a solid continuous shelf by installation of removable cover plates which cover one or more of the cut-out portions and thus alter the configuration provided, additional alternative interior configurations being possible by selective addition or removal of removable shelves supported by the vertical divider.

16 Claims, 4 Drawing Sheets

RECONFIGURABLE INTERIOR STRUCTURE FOR SAFES AND THE LIKE

BACKGROUND OF THE INVENTION

1. Field of the Invention

This invention relates generally to safes and like secure containers for protection of information, valuables, and secure storage of firearms or articles or substances which may pose a threat of harm. More particularly, the invention relates to configuration of shelving, dividers, racks and the like for internal space organization within such enclosures, receptacles or structures for secure storage or preservation of articles, herein being collectively referred to as safes.

2. Description of Related Art

In the manufacture of safes it is customary to provide within relatively larger safe interiors a number of shelves, combined with dividers, racks, etc. for organization of the interior space within the safe. Moreover, objects which may be desired to be secured within a safe can vary greatly in size, shape and quantity. For example, small coins, large ledger books, jewelry, gemstones, papers and computer data storage means containing valuable and/or sensitive information may need to be accommodated. Moreover, many safes are used to store firearms, including in some cases collections of rare and valuable guns. Such firearms may include rifles or shotguns of various sizes. Some gun collectors for example may wish to store such diverse types (and quantities) as muskets having a considerable length, and small handguns.

Conventionally, the accommodation of the needs of the user of the safe involves providing an interior shelf arrangement when the safe is constructed or prepared for delivery according to the specification of the customer. This involves keeping an inventory of various kinds and sizes of shelving, dividers, racks, etc. on hand at the place of manufacture and/or the point of purchase, and installation of same according to the preference of the customer.

This conventional scheme has the inherent disadvantage that every safe interior to some extent must be customized, increasing cost to the consumer due to extra costs involved with inventory and labor to configure the safe in accordance with the customer's desires. Moreover, if the needs of the customer change with time, and another interior configuration would be desirable, this is not easily accommodated.

What is needed, and has heretofore not been available, is an interior organizational system for safes that mitigates these problems. The present invention is directed to fulfilling this need.

SUMMARY OF THE INVENTION

Briefly, and in general terms, the present invention accordingly provides a reconfigurable interior structure for a safe including a rack disposed within the interior of a safe, this rack having a first side and a second side and a cut-out configuration defining a cut-out portion accommodating objects extending through the rack from the first side to the second side. A removable cover plate configured to cover at least a portion of the rack on at least one of said first and second sides is provided, this cover plate being adapted to cover the cut-out configuration to provide a continuous shelf, whereby different interior configurations accommodating different sized articles are provided when the cover plate is present and when the plate is removed.

In accordance with one aspect of the invention, a reconfigurable safe interior structure can provide a plurality of cut-out portions of said rack, and likewise a plurality of removable cover plates, each cover plate configured to cover at least a portion of the rack on at least one of said first and second sides and at least one cut-out portion. Additional variations in interior configuration are thus provided. Moreover, in another detailed aspect a cut-out portion can include one or more notches or indentations, each configured so as to stabilize a long vertically-oriented object such as a rifle barrel. By selective use of the cover plates one or more areas within the interior able to accommodate relatively long objects such as rifles or muskets can be created.

In accordance with another aspect of the invention, the reconfigurable interior structure for a safe can include a second (or more) rack or shelf disposed within said interior of a safe adjacent the first rack. This second shelf has a cut-out portion aligned vertically with respect to said cut-out portion of the first rack, whereby articles can pass vertically through the cut-out portions of both the rack and second shelf.

In a more detailed aspect, the reconfigurable interior structure can include a vertical divider extending from the bottom of the interior of the safe upward to the reconfigurable rack and disposed in the lower and central area of the interior of the safe. One or more removable shelves can be provided, supported by the vertical divider. By selective inclusion or exclusion of removable shelves additional variations in interior configuration are accommodated.

As can be appreciated the reconfigurable interior structure of the invention allows the user to configure the interior in any one of a great number of possible variations for organization of space to accommodate specific and changing needs, with the manufacturer being required to only stock and supply reconfigurable interior structures. With such an interior organizational system, a savings in cost of construction, shipping, after-market shipping, etc. of the safe can be realized. This savings can result in a lower cost to the customer. Also, the manufacturer and/or retailer is required to maintain less inventory, as an organizational system which is reconfigurable allows one interior structure to be provided for all safes made and sold. These and other aspects and advantages of the invention will become apparent from the following detailed description, and the accompanying drawing figures, which illustrate by way of example the features of the invention.

DESCRIPTION OF THE PREFERRED EMBODIMENTS

Figure 1:
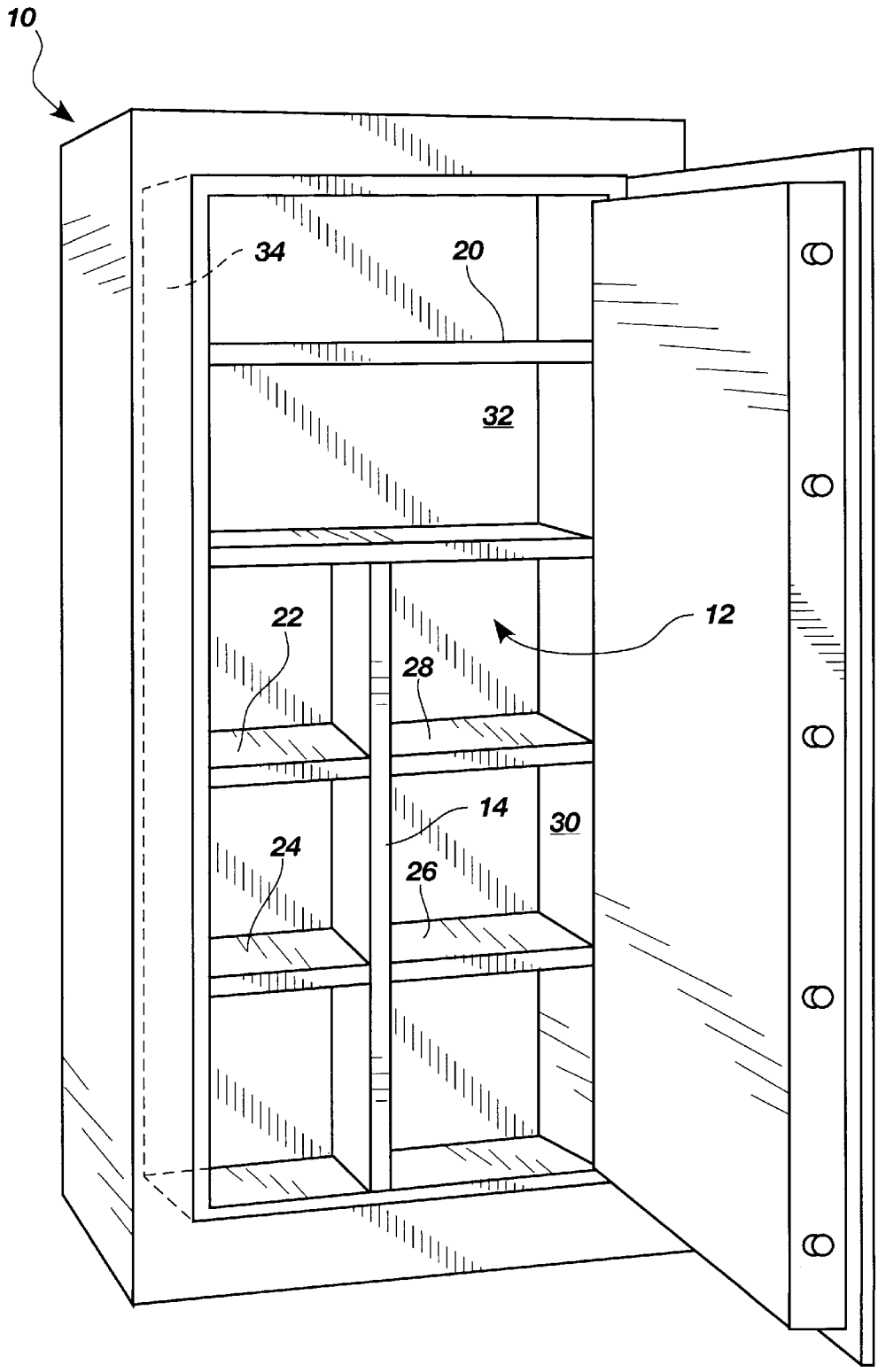
FIG. 1 of the drawings is a perspective view representation of a safe according to the invention, with its door open, illustrating one possible configuration of the reconfigurable interior structure of the invention.

As shown in FIG. 1 for purposes of illustration, the invention is shown embodied in a safe 10. A reconfigurable interior structure 12 comprises a vertical divider 14 and a reconfigurable rack 16 supported at a central location by the vertical divider. The shelf and divider are formed of wood, particle board, etc. and covered with fabric such as carpet, velour or similar fabric. The fabric provides a surface which has a relatively high coefficient of friction and an aesthetically pleasing appearance. The vertical divider and the reconfigurable shelf are relatively permanently installed by means of dowel pins, nails, screws, etc.

A further shelf 20 is adjustably positioned on shelf clips 37. This shelf has cut-out portions (not shown in FIG. 1) which can best be appreciated with reference to FIG. 3. Returning to FIG. 1, the reconfigurable interior structure 12 further comprises removable shelves 22, 24, 26, and 28 extending horizontally from the vertical divider and supported by the vertical divider and the interior walls 30, 32, and 34 by means of vertical shelf standards 35 and removable shelf support clips 37. The further shelf 20 and the removable shelves 22, 24, 26, and 28 are formed of fabric-covered wood, particle board, etc. like the reconfigurable rack 16 and vertical divider 14.

Figure 2:
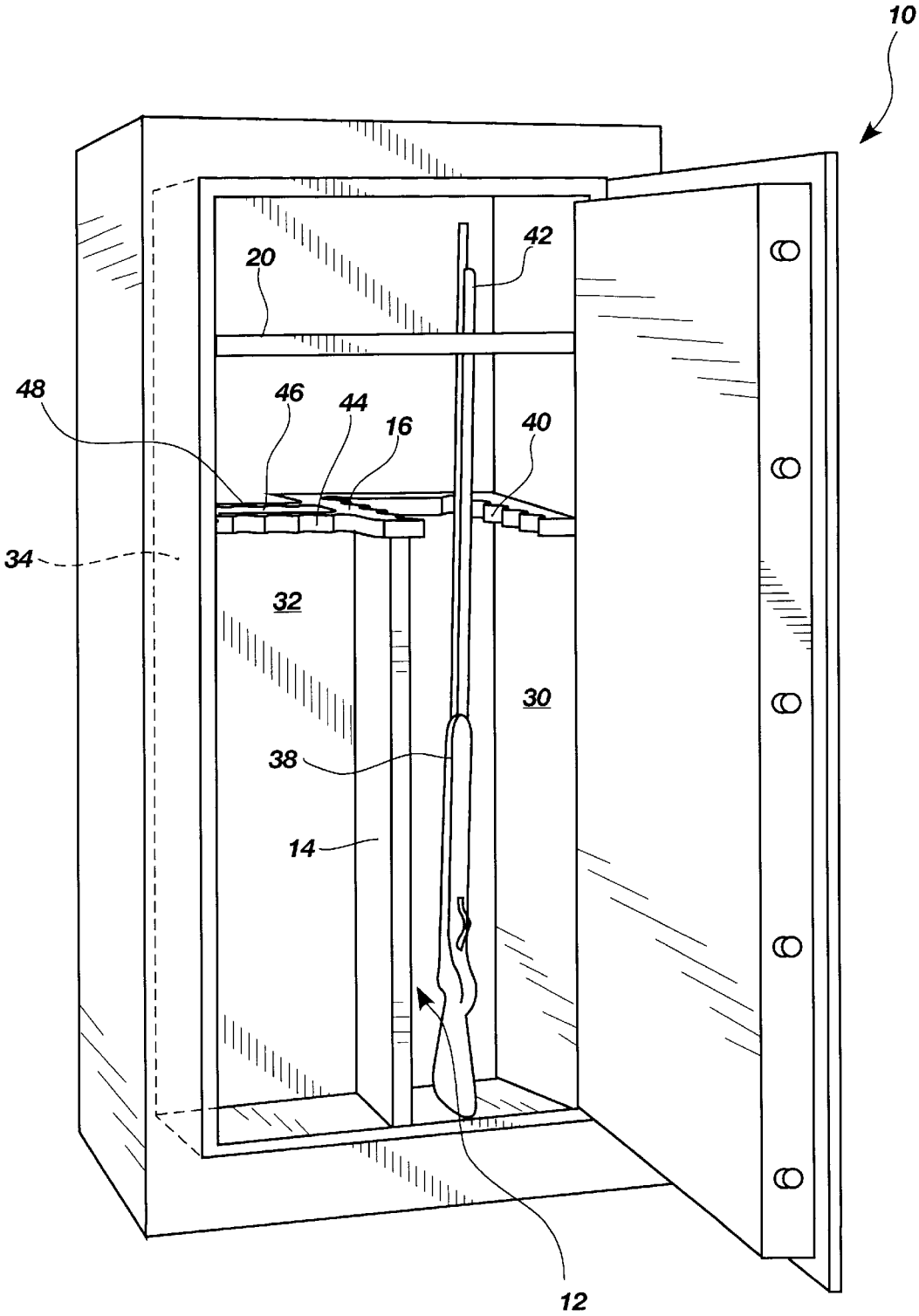
FIG. 2 of the drawings is a perspective view of the safe of FIG. 1 showing an alterative configuration of the reconfigurable interior structure.

With reference to FIG. 2, the reconfigurable interior structure 12 of the present invention is shown configured differently from that illustrated in FIG. 1. For example as illustrated in FIG. 2, the structure now will accommodate long narrow articles such as a firearm. A musket 38 is shown, which is received in a cut-out portion 40 of the reconfigurable rack 16. The cut-out portion shown has an undulating configuration adapted to receive and support firearms in a vertical orientation. A barrel 42 of the musket extends through a cut out portion (not shown) in the shelf 20 aligned with the cut-out portion 40 having an undulating configuration to allow a long object such as a barrel of a musket or rifle to pass through the shelf 20. Further cut-out portions 44, 46 and 48 are also provided in the reconfigurable rack 16 to accommodate further long narrow articles such as additional firearms, fishing poles, hunting bows, etc.

Figure 3:
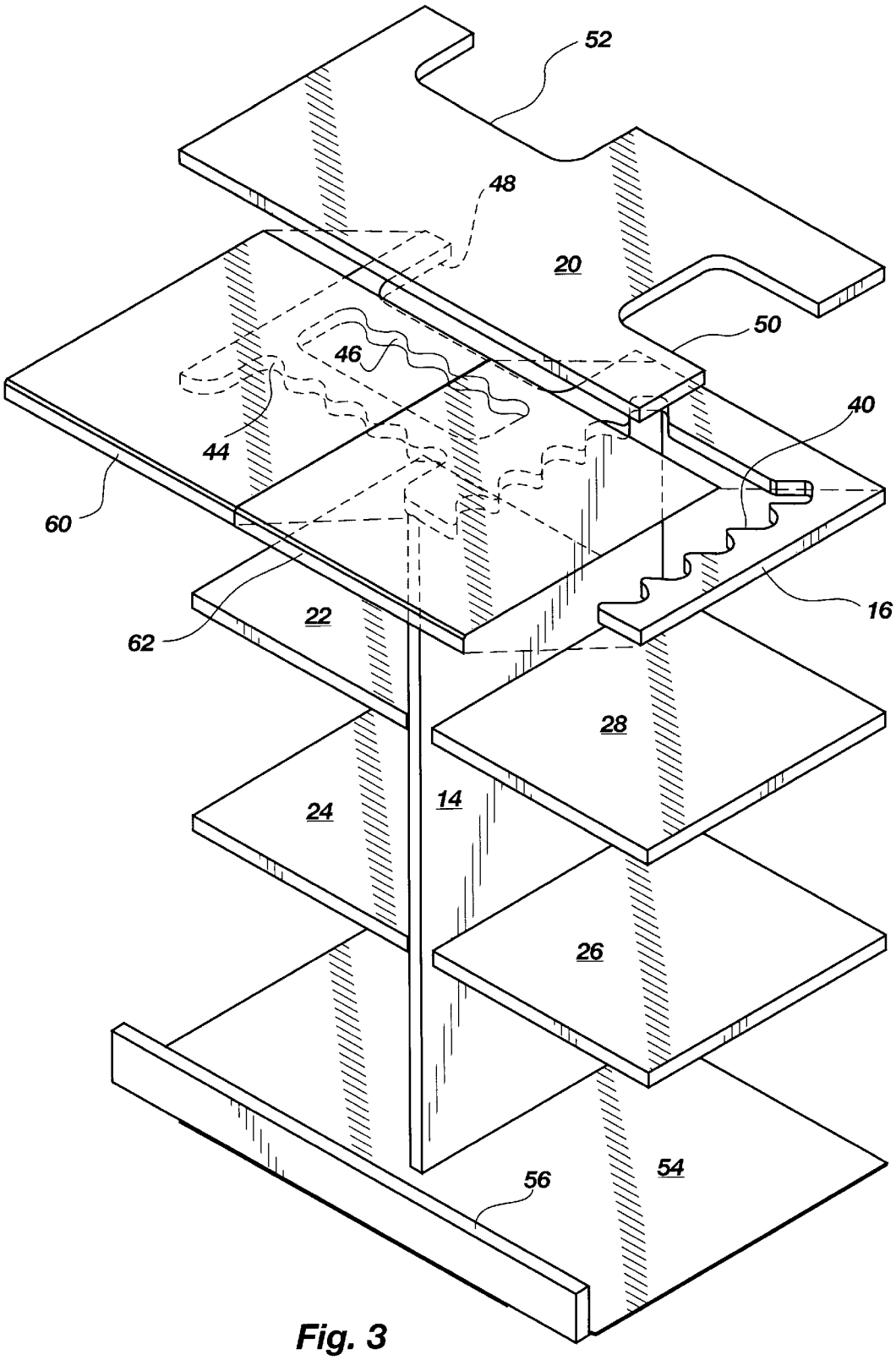
FIG. 3 of the drawings is a perspective view representation of a reconfigurable interior structure according to the invention shown outside a safe so that further details can be appreciated.
Figure 4:
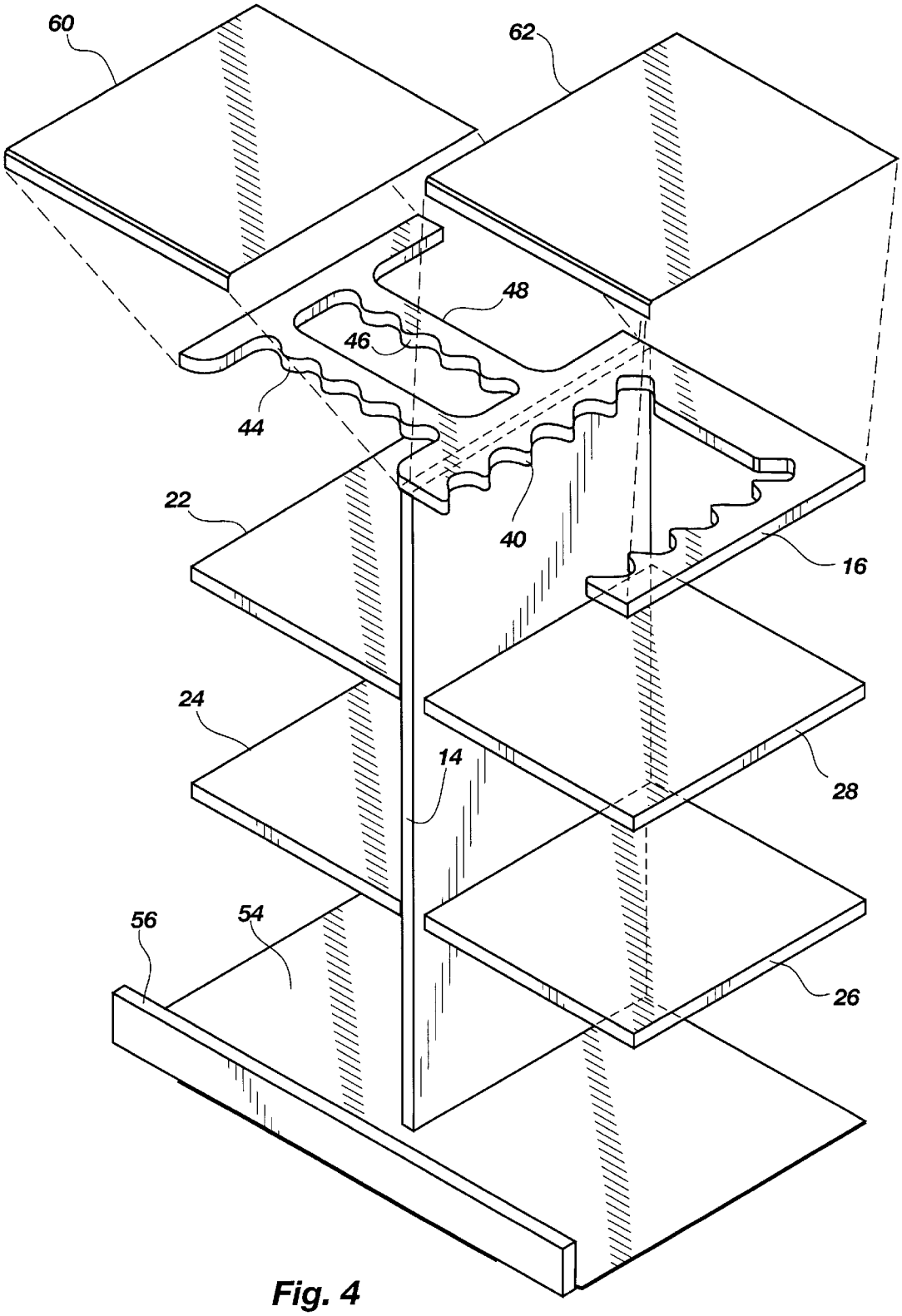
FIG. 4 of the drawings is a further perspective view of the reconfigurable interior structure show in FIG. 3 illustrating additional detail.

The features of the reconfigurable interior structure according to the invention can be further appreciated with reference to FIGS. 3 and 4. As can be seen, the shelf 20 may include two cut out portions 50 and 52 which are vertically aligned with cut out portions 40 and 48, respectively. This allows long articles, such as rifle barrels for example to pass through both reconfigurable rack 16 and shelf 20 when the interior structure is configured to accommodate such long articles.

The vertical divider 14 is supported by a base 54 formed of wood, particle board, etc. covered in fabric. A stop member 56 extends vertically from the base 54 at its front edge to protect rifles, etc. from metal edges in safes.

Reconfiguration of the interior of a safe 10 is conveniently accomplished by addition or removal of one or both of two cover plates 60 and 62 over the reconfigurable rack 16. These cover plates, which include a downwardly projecting front lip 61 and 63 respectively, when installed, give the reconfigurable shelf the appearance and functionality of a solid continuous horizontal shelf, such as is illustrated in FIG. 1. Again with reference to FIGS. 3 and 4, the cover plates are formed of steel, metal alloys, plastic, etc. and may be covered in fabric to match the rack 16 and shelves 20, 22, 24, 26, and 28 and vertical divider 14. The fabric covers of the cover plates and reconfigurable shelf provides a frictional resistance to relative movement and tends to hold the cover plates in place. Configurations providing a mechanical resistance to relative movement can be used. The downwardly projecting lips 61 and 63 cover the undulating cutouts of rack 16, presenting a solid appearance for the shelf.

It can be appreciated that if the right cover plate 62 is removed, along with removable shelves 26 and 28, long objects such as rifles can be accommodated. The same is true with respect to removal of the left cover plate 60 and removable shelves 22 and 24. Selective removal or installation of the cover plates and one or more of the removable shelves can provide a great number of possible alternative interior configurations. This is simple to do and reconfiguration can be performed at the point of purchase, and also can be done by the purchaser at a later time if need for a different interior configuration arises.

Right and left cover plates 62 and 60 can also be used to cover one or both cut-out portions 50 and 52 of the shelf 20. This will provide the appearance of a solid horizontal shelf as before described in connection with the reconfigurable rack 16. In another embodiment (not shown) further cover plates can be provided so that both rack 16 and shelf 20 can be covered. As can be appreciated the further shelf 20 is accordingly also reconfigurable by means of one or more cover plates such as those illustrated and described herein.

It will be apparent from the foregoing that while a particular form of the invention has been illustrated and described, various modifications can be made without departing from the spirit and scope of the invention. Accordingly, it is not intended that the scope of the invention be limited, except as by the limitations of the appended claims.

What is claimed is:

1. A reconfigurable interior structure housed within a locking metal safe having an interior, comprising:

a first reconfigurable rack disposed within the interior of the safe, said rack having a top side and a bottom side and further comprising a cut-out configuration defining a cut-out portion extending from the bottom side to the top side for accommodating vertically oriented objects extending through the rack from the bottom side to the top side;

a removable horizontal cover plate configured to cover and block at least a portion of the rack on at least said top side, said cover plate covering and blocking a portion of the cut-out configuration to provide a continuous horizontal shelf, whereby different interior configurations accommodating different sized articles are provided when the cover plate is present and when the cover plate is removed; and one or more horizontal shelves disposed within said interior of the safe disposed adjacent said rack, said one or more horizontal shelves having a cut-out portion aligned vertically with respect to said cut-out portion of the rack, whereby articles can pass vertically through the cut-out portions of both said rack and said one shelf.

2. The reconfigurable interior structure housed within the safe of claim 1, wherein said rack comprises a plurality of cut-out portions, said structure further comprising a plurality of removable horizontal cover plates, each plate configured to cover and block at least a portion of the rack on at least the top side and at least one cut-out portion.

3. The reconfigurable interior structure housed within the safe of claim 1, wherein said cut-out portion further comprises a notch configured so as to stabilize a vertically-oriented gun barrel.

4. A reconfigurable interior structure housed within a locking metal safe having an interior, comprising:

a first reconfigurable rack disposed within the interior of the safe, said rack having a top side and a bottom side and further comprising a cut-out configuration defining a cut-out portion extending from the bottom side to the top side for accommodating vertically oriented objects extending through the rack from the bottom side to the top side;

a removable horizontal cover plate configured to cover and block at least a portion of the rack on at least said top side, said cover plate covering and blocking a portion of the cut-out configuration to provide a continuous horizontal shelf, whereby different interior configurations accommodating different sized articles are provided when the cover plate is present and when the cover plate is removed; and at least one vertical divider extending from the bottom of the interior of the safe upwardly to at least the reconfigurable rack and supporting said rack.

5. The reconfigurable interior structure housed within the safe of claim 4, further comprising a removable horizontal shelf supported by the vertical divider.

6. The reconfigurable interior structure housed within the safe of claim 5, further comprising a plurality of removable horizontal shelves, at least one shelf being disposable adjacent a first side of the vertical divider and at least one shelf being disposable adjacent a second side of the vertical divider.

7. A reconfigurable interior structure housed within a locking metal safe having an interior, comprising:

a first reconfigurable rack disposed within the interior of the safe, said rack having a top side and a bottom side and further comprising a plurality of cut-out portions extending from the bottom side to the top side for accommodating vertically oriented objects extending through the rack from the bottom side to the top side;

a removable horizontal cover plate configured to cover and block at least a portion of the rack on at least said top side, said cover plate covering and blocking at least one cut-out portion to provide the appearance and function of a continuous horizontal shelf where said at least one cut-out portion is located, whereby different interior configurations accommodating different sized articles are provided when the cover plate is present and when the cover plate is removed;

at least one additional removable horizontal cover plate configured to cover and block at least another portion of the rack on at least said top side for covering at least another cut-out portion;

wherein said cut-out portion further comprises a notch configured so as to stabilize a vertically-oriented gun barrel; and at least one shelf disposed within said interior of the safe adjacent said rack, said at least one shelf having a cut-out portion aligned vertically with respect to at least one of said cut-out portions of the rack, whereby articles can pass vertically through the cut-out portions of both said rack and said at least one shelf.

8. The reconfigurable interior structure for a safe of claim 7, further comprising one or more vertical dividers extending from the bottom of the interior of the safe upwardly to at least the reconfigurable rack and supporting said rack.

9. The reconfigurable interior structure housed within the safe of claim 8, further comprising a removable horizontal shelf supported by the one or more vertical dividers.

10. The reconfigurable interior structure housed within the safe of claim 9, further comprising a plurality of removable horizontal shelves, at least one shelf being disposed adjacent a first side of the vertical divider and at least one shelf being disposed adjacent a second side of the vertical divider.

11. A reconfigurable interior structure housed within a locking metal safe having an interior, comprising:

a reconfigurable rack disposed within the interior of the safe, said rack having a top side and a bottom side and further comprising a plurality of cut-out portions extending from the bottom side to the top side for accommodating vertically oriented objects extending through the rack from the bottom side to the top side;

one or more removable horizontal cover plates configured to cover and block at least a portion of the rack on at least said top side, said one or more cover plates covering and blocking at least some of said cut-out portions to provide the appearance and function of a continuous horizontal shelf, whereby different interior configurations accommodating different sized articles are provided when at least one of the cover plates is present and when at least one of the cover plates is removed;

a vertical divider extending from the bottom of the interior of the safe upwardly to at least the reconfigurable rack and supporting said rack; and a removable horizontal shelf supported by the vertical divider.

12. The reconfigurable interior structure housed within the safe of claim 11, further comprising a plurality of removable horizontal shelves, at least one shelf being disposed adjacent a first side of the vertical divider and at least one shelf being disposed adjacent a second side of the vertical divider.

13. The reconfigurable interior structure housed within the safe of claim 11, wherein said cut-out portion further comprises a notch configured so as to stabilize a vertically-oriented gun barrel.

14. The reconfigurable interior structure housed within the safe of claim 13, further comprising a horizontal shelf disposed within said interior of the safe disposed adjacent said rack, said shelf having a cut-out portion aligned vertically with respect to at least one of said cut-out portions of the rack, whereby articles can pass vertically through the cut-out portions of both said rack and said shelf.

15. The reconfigurable interior structure housed within the safe of claim 14, wherein said shelves and cover plates are covered with a fabric covering.

16. The reconfigurable interior structure housed within the safe of claim 11, further comprising a base on which the vertical divider rests, said base including a front upwardly extending lip for retaining objects placed on the base.

* * * * *